US005636462A

United States Patent [19]

Kleiman

[11] Patent Number: 5,636,462

[45] Date of Patent: Jun. 10, 1997

[54] ILLUMINATED FLASHING MESSAGE DISPLAY SIGN APPARATUS WITH DIFFERENT OPERATIVE POSITIONS

[76] Inventor: Robert M. Kleiman, 6238 Ohm Ct., San Diego, Calif. 92122

[21] Appl. No.: 238,234

[22] Filed: May 4, 1994

[51] Int. Cl.[6] ..... G09F 21/04

[52] U.S. Cl. ..... 40/452; 40/442; 40/591; 248/126

[58] Field of Search ..... 40/452, 463, 530, 40/576, 442, 591, 593, 597, 606, 611; 362/800, 812; 248/126, 467, 206.1, 206.3, 291, 465, 454, 923; 14/334, 332

[56] References Cited

U.S. PATENT DOCUMENTS

| | | | |
|---|---|---|---|
| D. 104,569 | 5/1937 | Hammer | D20/10 |
| D. 111,585 | 10/1938 | Kay | D20/10 |
| D. 119,041 | 2/1940 | MacDonald et al. | D20/42 |
| 1,346,493 | 7/1920 | Hammond | 40/452 |
| 1,419,804 | 6/1922 | Berwald | 16/334 |
| 3,000,049 | 9/1961 | Terry, Jr. | 16/334 |
| 3,274,548 | 9/1966 | Brimsek | 340/473 |
| 3,583,734 | 6/1971 | Magi | 16/332 X |
| 3,750,138 | 7/1973 | Burgan et al. | 340/97 |
| 4,016,450 | 4/1977 | Balekjian | 40/542 |
| 4,328,481 | 5/1982 | Sexton | 340/473 |
| 4,456,126 | 6/1984 | Hicks, Jr. | 362/812 |
| 4,574,269 | 3/1986 | Miller | 340/97 |
| 4,580,829 | 4/1986 | Matheopoulos | 16/334 X |
| 4,607,444 | 8/1986 | Foster | 40/550 |
| 4,624,434 | 11/1986 | Lake, Jr. et al. | 248/454 |
| 4,711,044 | 12/1987 | Danjell | 40/540 |
| 4,751,494 | 6/1988 | Crotwell | 340/107 |
| 4,836,482 | 6/1989 | Sokol | 248/206.3 |
| 4,864,754 | 9/1989 | Sangu | 40/593 |
| 4,928,084 | 5/1990 | Reiser | 340/479 |
| 5,100,098 | 3/1992 | Hawkins | 248/291 |
| 5,230,174 | 7/1993 | Reed | 40/492 |
| 5,301,446 | 4/1994 | Kurtz | 40/591 |
| 5,412,842 | 5/1995 | Riblett | 16/334 |

FOREIGN PATENT DOCUMENTS

| | | | |
|---|---|---|---|
| 5265383 | 10/1993 | Japan | 40/219 |
| 432071 | 7/1935 | United Kingdom | 40/452 |

*Primary Examiner*—Kenneth J. Dorner
*Assistant Examiner*—Cassandra Davis
*Attorney, Agent, or Firm*—John R. Flanagan

[57] ABSTRACT

A message display sign apparatus includes a display panel having front and rear faces, a multiplicity of light emitting elements disposed on the front face of the display panel for displaying a built-in message on the display panel being defined by groups thereof being arranged to form the letters of the two words, a mounting panel having upper and lower faces, and a hinge pivotally interconnecting an edge of the display panel to an edge of the mounting panel such that the display panel and mounting panel can undergo pivotal movement relative to one another between a message display position in which the rear face of the display panel is angularly displaced away from the upper face of the mounting panel and a storage position in which the rear face of the display panel is disposed adjacent to the upper face of the mounting panel. The sign apparatus also includes an electrical control circuit connected to the light emitting elements and operable to cause alternating illumination of selected ones of the groups of light emitting elements and thereby of the letters of the two words defined by the groups of light emitting elements so as to flash the built-in message formed on the front face of the display panel.

8 Claims, 2 Drawing Sheets

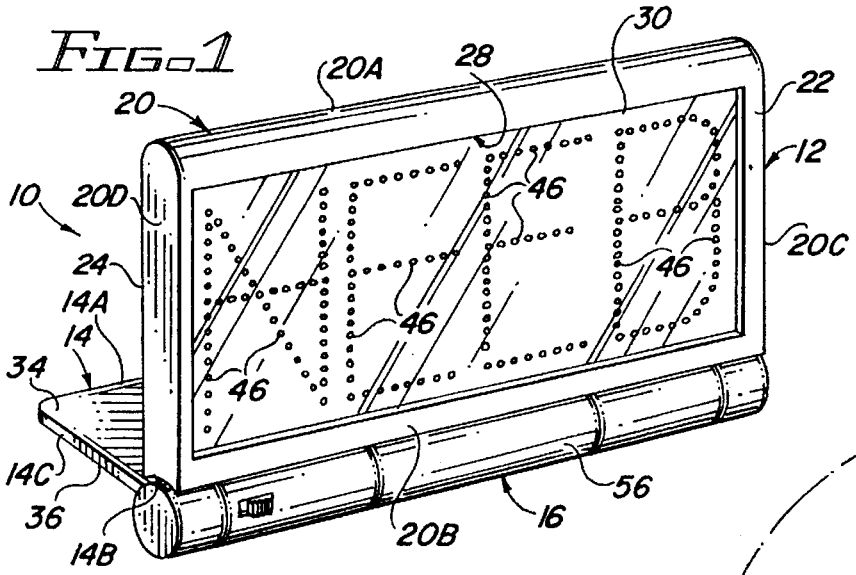
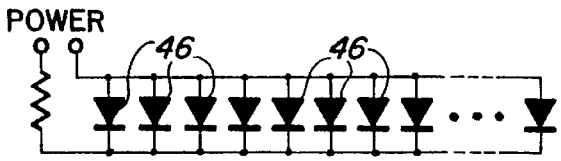
FIG. 7
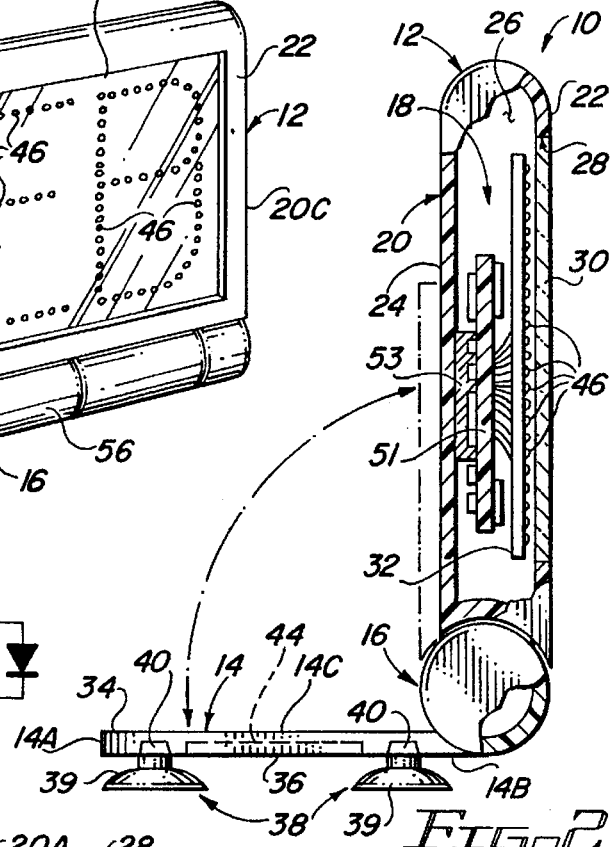
FIG. 2
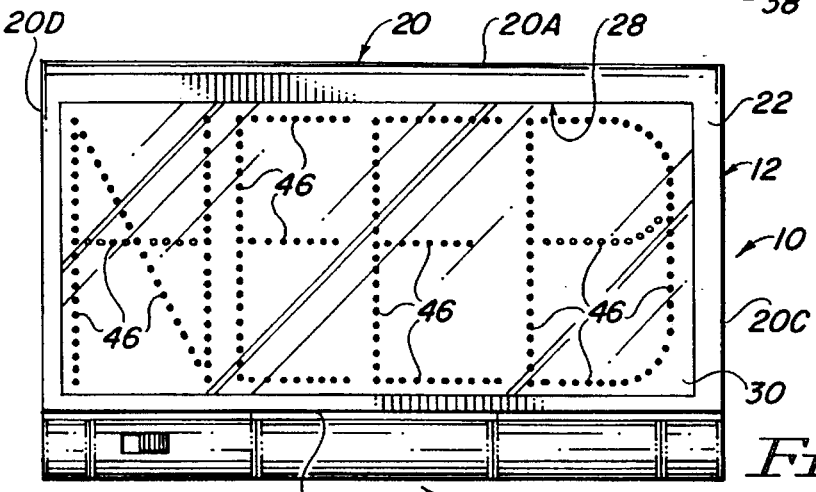
FIG. 3
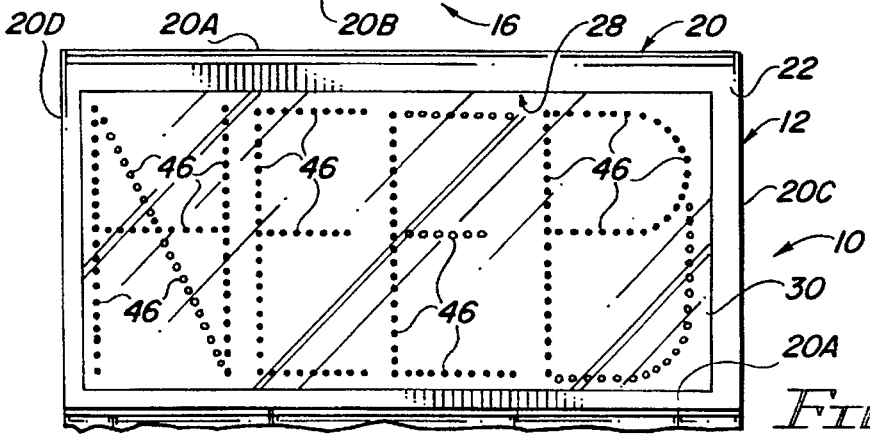
FIG. 4

ILLUMINATED FLASHING MESSAGE DISPLAY SIGN APPARATUS WITH DIFFERENT OPERATIVE POSITIONS

BACKGROUND OF THE INVENTION

1. Field of the Invention

The present invention generally relates to sign devices for displaying messages and, more particularly, is concerned with an illuminated flashing message display sign apparatus having different operative positions for accommodating different mounting and viewing requirements.

2. Description of the Prior Art

Notwithstanding the relatively high degree of reliability of most automobiles today and the widespread frequency of automobile service stations, it still remains likely that, from time to time, most persons will experience a breakdown of their vehicle on a country road, a limited access highway, or an interstate expressway, at a location remote from a service station. Such persons will likely require the help of another motorist traveling the same road and passing by the disabled vehicle. Before the assistance of another motorist can be obtained, it is necessary to call attention to the disabled situation of the vehicle and the stranded situation of the occupants thereof.

Display signs designed for communicating a message to indicate a disabled or distressed vehicle, such as an automobile, boat or the like, an emergency situation or some other happening are well-known in the prior art. Representative examples of such display signs are the one disclosed in U.S. Pat. No. to Brimsek U.S. Pat. No. (3,274,548), Burgan et al U.S. Pat. No. (3,750,138), Miller U.S. Pat. No. (4,574,269), Foster U.S. Pat. No. (4,607,444), Crotwell U.S. Pat. No. (4,751,494), Sangu U.S. Pat. No. (4,864,754) and Reiser U.S. Pat. No. (4,928,084).

To be a highly effective and useful device, such display sign devices should meet certain criteria. First, the device should be deployable and lockable in any one of a plurality of operative positions in which the device will accommodate various mounting and viewing requirements depending upon where it is used. Second, the device should be readily convertable to a storage position in which it occupies less space than when it is in any one of the operative positions. Third, the device should be adapted to be powered by either the electrical system of the vehicle or its own self-contained power supply, such as batteries. Fourth, the display of the device should be sufficiently bright to be readily observable specifically during the nighttime or inclement weather conditions. Fifth, the display of the device should be operable to flash the message so as to maximum its potential for attracting attention. Sixth, the display of the device should have storage compartments readily accessible and compact so as to be user friendly but not appreciably increase the overall space taken up by the device. Seventh, the device should be constructed of materials and by methods which are widely available and conventional and which make the device substantially mass producible and of relatively low cost in view of the benefits it provides to users.

While the devices of the above-cited patents meet some of the criteria set forth above, none meets all of the criteria. Consequently, a need still exists for a highly effective and user-friendly display sign device which meets the aforementioned criteria.

SUMMARY OF THE INVENTION

The present invention provides a message display sign apparatus designed to satisfy the aforementioned needs by addressing and substantially meeting all of the aforementioned criteria which prior art devices fail to do. The message display sign apparatus of the present invention generates an electronically illuminated bright flashing message and easily converts between a collapsed storage position and any one of a plurality of operative positions for accommodating different mounting and viewing requirements. Also, the message display sign apparatus is adapted to use electrical power from its own power supply or from that of the vehicle and provides storage compartments in spaces which would otherwise be wasted.

Accordingly, the present invention is directed to a message display sign apparatus which comprises: (a) a display panel having opposite front and rear faces; (b) means for displaying a message on the front face of the display panel; (c) a mounting panel having opposite upper and lower faces; and (d) hinge means pivotally interconnecting an edge of the display panel to an edge of the mounting panel such that the display panel and mounting panel can undergo pivotal movement relative to one another between a message display position in which the rear face of the display panel is angularly displaced away from the upper face of the mounting panel and a storage position in which the rear face of the display panel is disposed close to the upper face of the mounting panel.

Also, the sign apparatus further comprises a releasable latching mechanism coupled to the hinge means and being operable to releasably latch the display panel and mounting panel at selected ones of a plurality of different angularly-displaced mounting panel positions relative to one another, and means on the lower face of the mounting panel for attaching the mounting panel to a support surface. For example, the attaching means on the mounting panel can be at least one suction cup and/or at least one magnet.

The hinge means includes an inner elongated shaft connected at opposite ends to spaced opposite end portions of the edge of the display panel and an outer elongated sleeve connected to a central portion of the edge of the mounting panel. The outer sleeve and mounting panel therewith are pivotally movable relative to the inner shaft and display panel toward and away from the rear face of the display panel about a pivot axis defined by the hinge means.

The message displaying means includes a multiplicity of light emitting elements arranged in groups thereof defining letters of at least two words that form a built-in message on the display panel and an electrical control circuit connected to the light emitting elements and operable to cause alternating illumination of selected ones of the groups of light emitting elements and thereby of the letters of the two words defined by the groups of light emitting elements so as to flash the built-in message formed on the front face of the display panel. In flashing the built-in message, a first plurality of the groups of light emitting elements forming common portions of the letters of both words are turned on continuously by the electrical control circuit, whereas a second plurality and a third plurality of the groups of light emitting elements forming portions of the letters of one but not both of the words are turned on and off alternately by the electrical control circuit.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 1 is a perspective view of a message display sign apparatus of the present invention shown in a message display position.

FIG. 2 is an enlarged side elevational view of the apparatus with portions broken away to reveal internal components.

FIG. 3 is a front elevational view of the apparatus with selected ones of groups of the light emitting elements on a display panel of the apparatus being illuminated to form letters of the word "NEED".

FIG. 4 is a view similar to that of FIG. 3 but with selected ones of groups of the light emitting elements on the display panel being illuminated to form letters of the word "HELP".

FIG. 7 is a diagram of the connections between the light emitting elements comprising one of the plurality of groups thereof on the display panel.

DETAILED DESCRIPTION OF THE INVENTION

Figure 5:
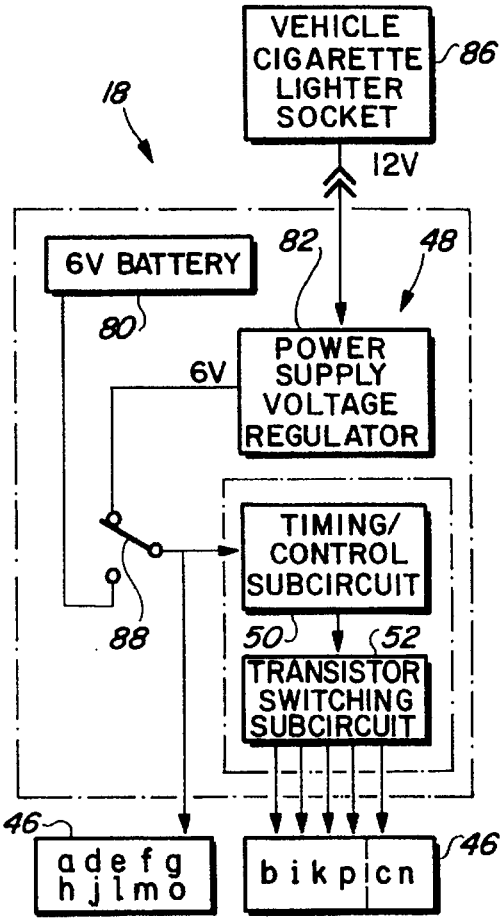
FIG. 5 is a block diagram of an electrical control circuit of the apparatus for effecting the alternating display and illumination of the built-in message on the display panel.

Referring to the drawings, and particularly to FIGS. 1 and 2, there is illustrated a message display sign apparatus of the present invention, being generally designated 10. Basically, the message display sign apparatus 10 includes a display panel 12, a mounting panel 14, a hinge arrangement 16 and means 18 for displaying a message on the display panel 12.

Referring still to FIGS. 1 and 2, the display panel 12 of the message display sign apparatus 10 includes a hollow housing 20 having opposite front and rear faces 22, 24 bounded by a pair of top and bottom longitudinal edges 20A, 20B and a pair of opposite side edges 20C, 20D defining an interior cavity 26 in the hollow housing 20. The front face 22 has a large rectangular opening 28 defined therein and a transparent pane defining a window 30 filling the opening 28. The display panel 12 also includes a display board 32 disposed within the interior cavity 26 of the housing 20 behind and across the window 30.

The mounting panel 14 of the message display sign apparatus 10 has opposite upper and lower faces 34, 36 bounded by a pair of outer and inner longitudinal edges 14A, 14B and a pair of opposite end edges 14C. The mounting panel 14 is preferably, but not necessarily, shorter in length and height than the display panel 12. preferably, the lower face 36 of the mounting panel 14 has means 38 thereon for attaching the mounting panel 14 to or upon a suitable support surface, such as an interior or exterior part of a vehicle. For example, referring to FIGS. 2 and 9, the attaching means 38 can be one or more suction cups 39 connected to respective corner regions of the mounting panel 14, such by threaded studs 40 connected to the suction cups 39 being screwed into corresponding threaded apertures 42 in the mounting panel 14. Also, the attaching means 38 can take the form of a magnetic strip or plate 44 inset in the mounting panel 14.

Referring to FIGS. 1–7, the message displaying means 18 of the apparatus 10 includes a multiplicity of light emitting elements 46 and an electrical control circuit 48 connected to the light emitting elements 46 and containing components operable to control the operation thereof, as will be described below. The light elements 46 preferably are light emitting diodes, or LEDs, arranged in a plurality of groups thereof, being identified in FIG. 6 by the letters "a" through "p". The groups of light emitting elements 46 together define portions or segments of the letters making up, for example, two words, such as "NEED" and "HELP", and therefore, the groups of light emitting elements 46 form a built-in message on the display panel 12. The light emitting elements 46 are supported on the display board 32 adjacent to the window 30 on the front face 22 of the housing 20.

Referring to FIGS. 3–6, as mentioned above the light emitting elements 46 are arranged in groups thereof so as to define portions or segments of letters of the two words that form the built-in message on the display panel 12. The groups of light emitting elements 46 on the display panel 12 identified as "a", "b", "d" to "m", "o" and "p" in FIG. 6 must be turned on and illuminated to form the letters of the word "NEED", whereas the groups of light emitting elements 64 on the display panel 12 identified as "a", "c" to "h", "j" and "l" to "o" in FIG. 6 must be turned on and illuminated to form the letters of the word "HELP". It will be noted that a first plurality of the groups of light emitting elements 46 on the display panel 12 identified as "a", "d" to "h", "j", "l", "m" and "o" are shared by both words, therefore, these groups are constantly on and illuminated in the forming both of the words. Thus, in order to transition or switch back and forth between the two words and thus cause flashing of the message, it will be readily understood and appreciated that only a second plurality of the groups of light emitting elements 46 identified as "b", "i", "k" and "p" need to be switched on and off in alternating fashion with a third plurality of the groups of light emitting elements 64 identified as "c" and "n". In FIGS. 3 and 4, the dots represent light emitting elements 46 that are turned on, whereas the circles represent light emitting elements 46 that are turned off.

Figure 6:
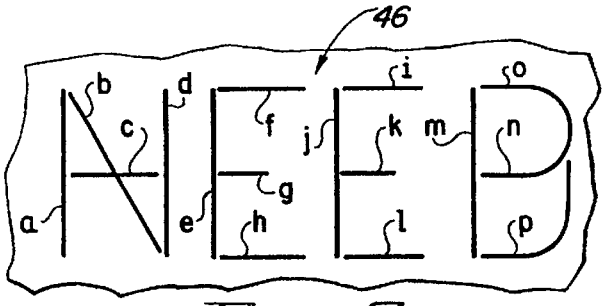
FIG. 6 is a diagrammatic representation of the plurality of groups of the light emitting elements making up portions or segments of the letters of two words forming the built-in message on the display panel.

Referring to FIG. 6, the electrical control circuit 48 includes components for doing this in the form of a timing/control subcircuit 50 and a transistor switching subcircuit 52 mounted on a power supply and control circuit board 51. Also, a heat sink spacer 53 is disposed between the circuit board 51 and the rear face 24 of the display panel 12 to facilitate the dissipation of heat generated by the components on the board 51. These subcircuits 50, 52 are each made up of conventional components within the knowledge of one of ordinary skill in the art and thus need not be illustrated nor described in detail to gain a complete understanding of the present invention. Suffice it to say, the timing/control subcircuit 50 may utilize an astable multivibrator timer which when supplied with suitable electrical power will alternate between on and off, or digital high and low, states of preset durations, such as a half second each, while the transistor switching subcircuit 52 may utilize two medium power transistors, electrically connected to the astable multivibrator timer, which, in turn, alternately and oppositely drive the second and third pluralities of groups of light emitting elements 46 between high (on) and low (off) states. The groups of light emitting elements 46 in the first plurality thereof are not switched but instead are always maintained on and emitting light. In such manner, the letters of the two words defined by the groups of light emitting elements 46 are alternately illuminated so as to produce flashing of the built-in message formed on the front face 22 of the display panel 12.

Referring to FIGS. 1, 2, 8 and 9, the hinge arrangement 16 of the message display sign apparatus 10 pivotally interconnects the display panel 12 and the mounting panel 14. The hinge arrangement 16 includes an inner elongated shaft 54 connected at opposite ends to spaced opposite end portions of the bottom longitudinal edge 20B of the display panel 12, and an outer elongated sleeve 56 connected to a central portion of the inner longitudinal edge 14B of the mounting panel 14. The outer sleeve 56 extends over the inner shaft 54 and is rotatably movable relative thereto about a pivot axis A defined by the hinge arrangement 16. Such relative rotational movement between the sleeve 56 and shaft 54 causes relative pivotal movement between the mounting panel 14 and display panel 12 with the upper face 34 of the mounting panel 14 moving toward or away from the rear face 24 of the display panel 12.

Figure 8:
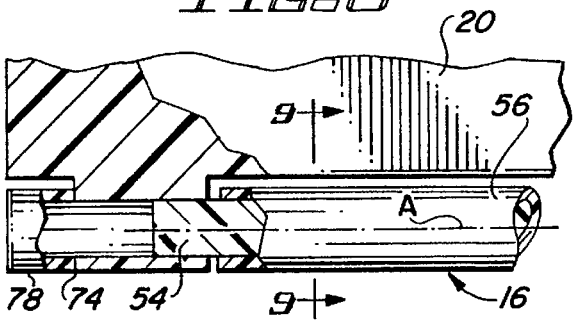
FIG. 8 is an enlarged fragmentary view of the apparatus, with portions broken away and sectioned, to show a hinge arrangement between the display panel and mounting panel of the apparatus.
Figure 9:
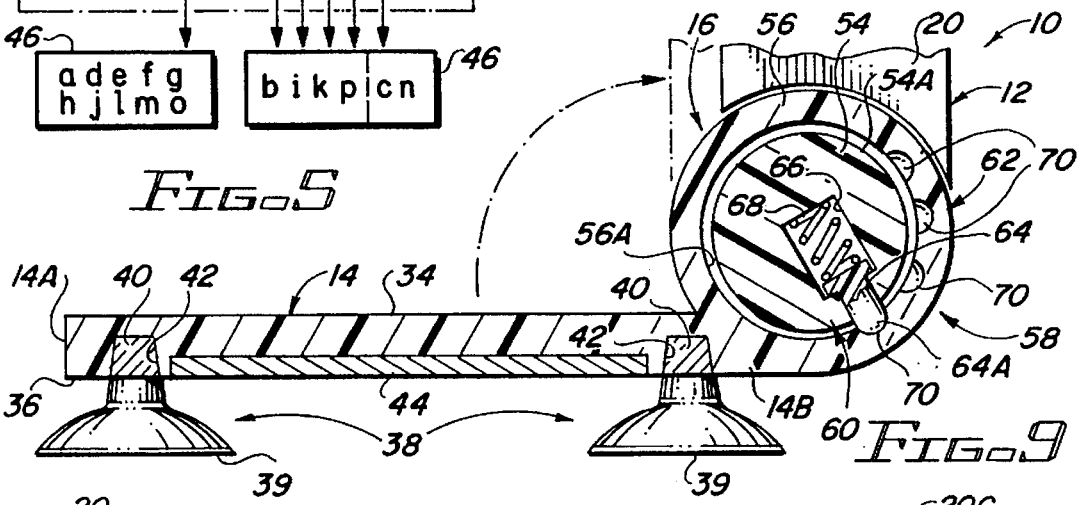
FIG. 9 is a fragmentary view of the display and support panels of the apparatus showing a releasable latching mechanism employed to latch the mounting panel at different/ones of a plurality of different angular positions relative to the display panel.
Figure 10:
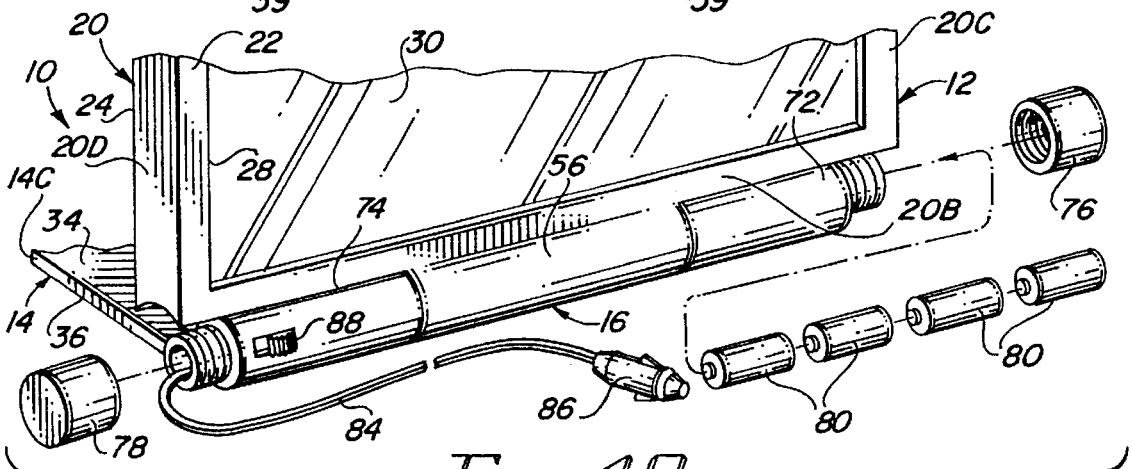
FIG. 10 is an enlarged fragmentary perspective of the apparatus depicting the storage compartments at the opposite ends of the hinge arrangement.

Referring to FIGS. 8 and 9, the apparatus 10 also preferably includes a releasable latching mechanism 58 coupled to the shaft 54 and sleeve 56 of the hinge arrangement 16 and being operable to releasably latch the display panel 12 and mounting panel 14 at selected ones of a plurality of different angularly-displaced mounting panel positions relative to one another. The releasable latching mechanism 58 has first and second cooperable complementary elements 60, 62 respectively defined on the inner shaft 54 and outer sleeve 56 and being operable to releasably latch the display panel 12 and mounting panel 14 at selected ones of the plurality of different angularly-displaced message display positions. The first cooperable complementary element 60 of the releasable latching mechanism 58 includes a pin 64 reciprocably mounted within a cavity 66 formed in the shaft 54 and a spring 68 disposed in the cavity 66 behind the reciprocable pin 64 for biasing the pin 64 to yieldably protrude at an outer end 64A from the cavity 66 and radially outwardly beyond an exterior surface 54A of the shaft 54. The second cooperable complementary element 62 of the releasable latching mechanism 58 includes a plurality of detents 70 defined in an interior surface 56A of the sleeve 56 and being spaced from one another along a circumferential path about the interior surface 56A of the sleeve 56 and aligned with the outer end 64A of the outwardly-biased pin 64 such that successive ones of the detents 70 can be brought into alignment with the outer end 64A of the pin 64 as the mounting panel 14 and sleeve 56 are pivotally moved relative to the display panel 12 and shaft 54.

Referring to FIGS. 1, 3, 8 and 10, the message display sign apparatus 10 also includes a pair of tubular compartments 72, 74 connected to the opposite end portions of the bottom longitudinal edge 20B of the housing 20 of the display panel 12 which, in turn, rigidly mount the opposite ends of the inner elongated shaft 54 of the hinge arrangement 16. The compartments 72, 74 are provided with screw-on end caps or closures 76, 78. The apparatus 10 further includes a plurality of batteries 80 being removably received in the one compartment 72 and means 82 for supplying electrical power from an external source and having an electrical cord 84 with a plug 86 being removably received in the other of the compartments 74. The electrical control circuit 48 has a switch 88 mounted on the other compartment 74 which is operable to electrically connect the electrical control circuit 48 alternatively with one or the other of the batteries 80 or the electrical power supplying means 82.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A message display sign apparatus, comprising:

(a) a display panel having opposite front and rear faces bounded by a pair of top and bottom longitudinal edges and a pair of opposite side edges;

(b) means for displaying a message on said front face of said display panel, said message displaying means including (i) a multiplicity of light emitting elements arranged in groups thereof together defining the letters of at least two words so as to form a built-in message on said display panel, and (ii) an electrical control circuit connected to said light emitting elements and operable to cause alternating illumination of selected ones of said groups of light emitting elements and thereby of the letters of the two words defined by said groups of light emitting elements so as to flash said built-in message formed on said front face of said display panel;

(c) a mounting panel having opposite upper and lower faces bounded by a pair of outer and inner longitudinal edges and a pair of opposite end edges, said mounting panel being shorter in length and height than said display panel;

(d) a hinge arrangement pivotally interconnecting said display panel and said mounting panel, said hinge arrangement having an inner elongated shaft connected at opposite ends to spaced opposite end portions of said bottom longitudinal edge of said display panel and an outer elongated sleeve connected to a central portion of said inner longitudinal edge of said mounting panel, said outer sleeve of said hinge arrangement and said mounting panel therewith being pivotally movable relative to said inner shaft and to said rear face of said display panel about a pivot axis defined by said hinge arrangement;

(e) means on said lower face of said mounting panel for attaching said mounting panel to a support surface;

(f) a pair of tubular compartments connected to said opposite end portions of said bottom longitudinal edge of said display panel and supporting said opposite ends of said inner elongated shaft; and (g) a pair of closures removably attached to open ends of said tubular compartments.

2. The apparatus of claim 1 wherein selected ones of said groups of light emitting elements on said display panel can be illuminated to form the letters of the word "NEED".

3. The apparatus of claim 1 wherein selected ones of said groups of light emitting elements on said display panel can be illuminated to form the letters of the word "HELP".

4. The apparatus of claim 1 wherein a first plurality of said groups of light emitting elements forming portions of the letters of both words are turned on continuously by said electrical circuit.

5. The apparatus of claim 4 wherein a second plurality and a third plurality of said groups of light emitting elements forming portions of the letters of one but not both of the words are turned on and off alternately.

6. The apparatus of claim 1 further comprising:

a plurality of batteries being removably received in one of said compartments;

means for supplying electrical power from an external source and having an electrical cord with a plug being removably received in the other of said compartments; and said electrical control circuit having a switch operable to connect said circuit with one or the other of said batteries and electrical power supplying means.

7. A message display sign apparatus, comprising:

(a) a display panel having opposite front and rear faces bounded by a pair of top and bottom longitudinal edges and a pair of opposite side edges;

(b) means for displaying a message on said front face of said display panel, said message displaying means including (i) a multiplicity of light emitting elements arranged together to define the letters of at least one word so as to form a built-in message on said display panel, and (ii) an electrical control circuit connected to said light emitting elements and operable to cause illumination of selected ones of said light emitting elements and thereby of the letters of the word defined by said light emitting elements so as to illuminate said built-in message formed on said front face of said display panel;

(c) a mounting panel having opposite upper and lower faces bounded by a pair of outer and inner longitudinal edges and a pair of opposite end edges, said mounting panel being shorter in length and height than said display panel;

(d) a hinge arrangement pivotally interconnecting said display panel and said mounting panel, said hinge arrangement having an inner elongated shaft connected at opposite ends to spaced opposite end portions of said bottom longitudinal edge of said display panel and an outer elongated sleeve connected to a central portion of said inner longitudinal edge of said mounting panel, said outer sleeve of said hinge arrangement and said mounting panel therewith being pivotally movable relative to said inner shaft and to said rear face of said display panel about a pivot axis defined by said hinge arrangement;

(e) means on said lower face of said mounting panel for attaching said mounting panel to a support surface;

(f) a tubular compartment connected to one of said opposite end portions of said bottom longitudinal edge of said display panel and supporting one of said opposite ends of said inner elongated shaft;

(g) a closure removably attached to an open end of said one tubular compartment; and (h) a plurality of batteries being removably received in said one tubular compartment, said electrical control circuit having a switch operable to connect said circuit with said batteries.

8. A message display sign apparatus, comprising:

(a) a display panel having opposite front and rear faces bounded by a pair of top and bottom longitudinal edges and a pair of opposite side edges;

(b) means for displaying a message on said front face of said display panel, said message displaying means including (i) a multiplicity of light emitting elements arranged together to define the letters of at least one word so as to form a built-in message on said display panel, and (ii) an electrical control circuit connected to said light emitting elements and operable to cause illumination of selected ones of said light emitting elements and thereby of the letters of the word defined by said light emitting elements so as to illuminate said built-in message formed on said front face of said display panel;

(c) a mounting panel having opposite upper and lower faces bounded by a pair of outer and inner longitudinal edges and a pair of opposite end edges, said mounting panel being shorter in length and height than said display panel;

(d) a hinge arrangement pivotally interconnecting said display panel and said mounting panel, said hinge arrangement having an inner elongated shaft connected at opposite ends to spaced opposite end portions of said bottom longitudinal edge of said display panel and an outer elongated sleeve connected to a central portion of said inner longitudinal edge of said mounting panel, said outer sleeve of said hinge arrangement and said mounting panel therewith being pivotally movable relative to said inner shaft and to said rear face of said display panel about a pivot axis defined by said hinge arrangement;

(e) means on said lower face of said mounting panel for attaching said mounting panel to a support surface;

(f) a tubular compartment connected to one of said opposite end portions of said bottom longitudinal edge of said display panel and supporting one of said opposite ends of said inner elongated shaft;

(g) a closure removably attached to an open end of said one tubular compartment; and (h) means for supplying electrical power from an external source and having an electrical cord with a plug being removably received in said one compartment, said electrical control circuit having a switch operable to connect said circuit with said cord of said electrical power supplying means.

* * * * *